US008433087B2

(12) United States Patent
Nordahn et al.

(10) Patent No.: US 8,433,087 B2
(45) **Date of Patent: *Apr. 30, 2013**

(54) HEARING AID AND METHOD OF COMPENSATION FOR DIRECT SOUND IN HEARING AIDS

(75) Inventors: Morten Agerbaek Nordahn, Bronshoj (DK); David Morris, Malmo (SE)

(73) Assignee: Widex A/S, Lynge (DK)

( * ) Notice: Subject to any disclaimer, the term of this patent is extended or adjusted under 35 U.S.C. 154(b) by 1204 days.

This patent is subject to a terminal disclaimer.

(21) Appl. No.: 12/185,902

(22) Filed: Aug. 5, 2008

(65) Prior Publication Data

US 2008/0292122 A1 Nov. 27, 2008

Related U.S. Application Data

(63) Continuation-in-part of application No. PCT/EP2007/051891, filed on Feb. 28, 2007.

(60) Provisional application No. 60/778,377, filed on Mar. 3, 2006.

(51) Int. Cl.
*H04R 25/00* (2006.01)

(52) U.S. Cl.
USPC ..... 381/321; 381/312; 381/317

(58) Field of Classification Search ..... 381/312–331
See application file for complete search history.

(56) References Cited

U.S. PATENT DOCUMENTS

| | | | | |
|---|---|---|---|---|
| 5,033,090 | A | 7/1991 | Weinrich | |
| 6,275,596 | B1 * | 8/2001 | Fretz et al. | 381/321 |
| 2005/0013456 | A1 | 1/2005 | Chalupper | |

FOREIGN PATENT DOCUMENTS

| | | | |
|---|---|---|---|
| EP | 1689210 | A2 | 8/2006 |
| JP | 2000102098 | A | 4/2000 |
| WO | 2005051039 | A1 | 6/2005 |
| WO | 2006/118819 | A2 | 11/2006 |
| WO | 2007/045271 | A1 | 4/2007 |

OTHER PUBLICATIONS

Francis Kuk et al, "Fitting Tips: How Do Vents Affect Hearing Aid Performance", Hearing Review, Feb. 2006.

American National Standard—Methods for Calculation of the Speech Intelligibility Index—ANSI S3.5-1997.

American National Standard—Methods for the Calculation of the Articulation Index—ANSI S3.5-1969.

D. A. Preves et al, "A Feedback Stablilizing Circuit for Hearing Aids", Hearing Instruments, Harcourt Brack Jovanovich Publishing, Duluth, Minnesota, US, vol. 37, No. 4, Apr. 1986, pp. 34, 36-41, 51 XP000796174.

* cited by examiner

*Primary Examiner* — Duc Nguyen
*Assistant Examiner* — Matthew Eason
(74) *Attorney, Agent, or Firm* — Sughrue Mion, PLLC

(57) ABSTRACT

A hearing aid (200) comprises at least one microphone (210), a signal processing means (220) and an output transducer (230). The signal processing means is adapted to receive an input signal from the microphone. The signal processing means is adapted to apply a hearing aid gain to the input signal to produce an output signal to be output by the output transducer, and the signal processing means further comprises means for adjusting the hearing aid gain up or down until the hearing aid gain differs from the direct transmission gain by more than a predetermined value.

17 Claims, 7 Drawing Sheets

HEARING AID AND METHOD OF COMPENSATION FOR DIRECT SOUND IN HEARING AIDS

RELATED APPLICATIONS

The present application is a continuation-in-part of application no. PCT/EP2007/051891 filed on Feb. 28, 2007 and published as WO-A1-2007099116, the contents of which are incorporated herein by reference. The present application further claims priority from U.S. 60/778,377, filed on Mar. 3, 2006, the contents of which are incorporated herein by reference.

BACKGROUND OF THE INVENTION

1. Field of the Invention

The present invention relates to the field of hearing aids. The invention more specifically relates to hearing aids utilizing compensation for direct sound. The invention, more particularly relates to hearing aids having means for adjusting the hearing aid gain based on a rationale that takes into account the direct sound propagation around the hearing aid earpiece, and, still more particularly, respective systems and methods thereof.

2. Description of the Related Art

Hearing aids are adapted for providing at the users eardrum a version of the acoustic environment that has been amplified according to the users prescription. This is normally achieved by providing a device with a microphone, an amplifier and a miniature loudspeaker situated in an earpiece placed in the users ear canal. It is well known that there may be acoustic leaks around the earpiece. There may e.g. be a non-sealed fit or there may be a vent deliberately arranged in the earpiece for considerations about user comfort, e.g. for relieving the sound pressure created by the users own voice. Such leaks may cause a loss in sound pressure and they may allow sound to bypass the hearing aid to reach the ear drum.

WO-A1-2007045271 (PCT application PCT/EP2005/055305) titled "Method and system for fitting a hearing aid", the contents of which are hereby incorporated by reference, provides a method for estimating otherwise unknown functions such as the vent effect and the direct transmission gain for an in-situ hearing aid. The derived estimate of the direct transmission gain represents the amplification of sound from the outside of the vent to the eardrum. These functions are used for correcting the in-situ audiogram, the hearing aid gain as well as the direct transmission gain according to the vent effect.

It is a widely known problem in hearing aid design that a hearing aid gain is often applied without taking into account the acoustic effect of the ventilation canal and/or a leakage path between the earplug of the hearing aid and the ear canal.

In hearing aids with open fittings or large ventilation canals, sound may propagate around the hearing aid earpiece, e.g. directly through the vent, to be superimposed onto the sound amplified by the hearing aid. In case these two sound signals are of similar amplitude, the summed signal may at certain frequencies be infinitely small if the relative phase between the signals is 180°. Such a phase disrupted signal has an unnatural rasping sound, and e.g. speech intelligibility may suffer as a consequence. The degree to which this is a problem depends on the individual hearing loss and the earplug. To the best knowledge of the inventors this problem has not been addressed in hearing aid fitting according to the prior art.

Therefore, acoustic effects of the ventilation canal and possible leakage paths between the hearing aid and the ear canal are still challenges in today's hearing aid fitting strategies.

Thus, there is a need for improved hearing aids as well as improved techniques for adapting the fitting rationale to take into account the direct sound propagation.

SUMMARY OF THE INVENTION

It is therefore an object of the present invention to provide hearing aids and methods of processing signals in a hearing aid taking in particular the mentioned requirements and drawbacks of the prior art into account.

It is in particular an object of the present invention to provide a hearing aid and a respective method of providing a compensation that takes into account the amount of sound bypassing the earpiece, e.g. propagated around the earpiece or directly through the vent.

According to a first aspect of the present invention, there is provided a hearing aid comprising at least one microphone, a signal processing means and an output transducer, said signal processing means being adapted to receive an input signal from the microphone, and to apply a hearing aid gain to said input signal to produce an output signal to be output by said output transducer, wherein said signal processing means further comprises means for adjusting said hearing aid gain to a magnitude that differs by a predetermined margin from a direct transmission gain calculated for direct sound bypassing the hearing aid when worn by the user.

The hearing aid with means for adjusting the hearing aid gain according to a direct transmission gain takes advantage of knowledge about the amount of directly transmitted sound and information about how much a certain frequency band may be attenuated before the direct sound becomes dominant over the amplified sound.

According to another aspect of the present invention, there is provided a hearing aid that is capable of avoiding phase disruption in the output signal by taking the direct transmitted sound into account when calculating the hearing aid gain to produce the output signal.

According to a second aspect of the present invention, there is provided a method of compensating direct transmitted sound in a hearing aid, comprising, estimating an effective vent parameter for said hearing aid; calculating a direct transmission gain based on said effective vent parameter; calculating a hearing aid gain suitable to produce from an input signal a hearing deficit compensation output signal; comparing the hearing aid gain to said direct transmission gain; and—further adjusting said hearing aid gain up or down to a magnitude that differs from said direct transmission gain by more than a predetermined value.

According to a further aspect of the present invention, there is provided a method of compensating direct transmitted sound in a hearing aid which comprises the steps of estimating an effective vent parameter for the hearing aid, calculating a direct transmission gain based on the effective vent parameter, applying a hearing aid gain to produce an output signal from an input signal wherein the direct transmission gain is used as a lower gain limit below which the hearing aid gain is not set.

According to still another aspect of the present invention, there is provided a method of determining direct transmitted sound in a hearing aid which comprises the steps of estimating an effective vent parameter for the hearing aid, and calculating a direct transmission gain based on the effective vent parameter.

The methods provided enable a calculation of the direct transmission gain once when fitting the hearing aid, which may then be used according to further methods and systems according to the present invention for the dynamic correction of also other hearing aid parameters than gain.

It may be seen as a true advantage that the hearing aids, systems and methods according to the present invention provide the ability to adjust the hearing aid gain to compensate for the interaction of directly transmitted sound and the sound amplified by the hearing aid gain in real time.

According to an embodiment of the present invention the hearing aid is able to dynamically adjust the hearing aid gain in each frequency band based on the instantaneous gain level.

The invention, in a third aspect, provides a computer program product containing a computer readable medium with executable program code which, when executed on a computer, executes a method of compensating direct transmitted sound in a hearing aid, the method comprising estimating an effective vent parameter for said hearing aid; calculating a direct transmission gain based on said effective vent parameter;

calculating a hearing aid gain suitable to produce from an input signal a hearing deficit compensation output signal; comparing the hearing aid gain to said direct transmission gain; and further adjusting said hearing aid gain up or down to a magnitude that differs from said direct transmission gain by more than a predetermined value.

Further specific variations of the invention are defined by the further claims.

Other aspects and advantages of the present invention will become more apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, wherein like reference numerals designate like structural elements, and in which.

DESCRIPTION OF EMBODIMENTS OF THE INVENTION

Figure 1A:
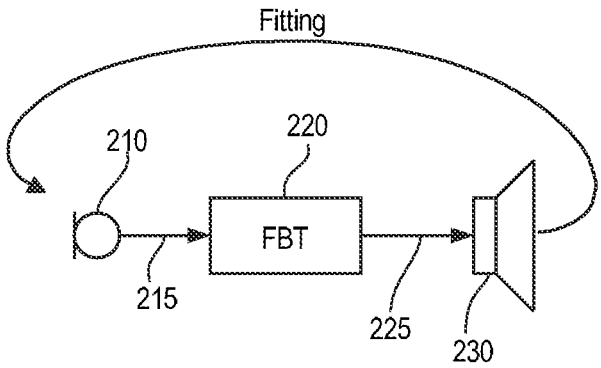
FIG. 1*a* depicts a schematic diagram regarding calculation of the direct transmitted sound.

Reference is first made to FIG. 1*a* for an explanation regarding calculating the DTG. The calculation of the DTG is done by performing a feedback test (FBT), as schematically illustrated in FIG. 1*a*. Then, the in-situ vent effect is estimated and the DTG is calculated from the vent effect. Document WO-A1-2007045271 (mentioned above) describes this in detail.

Figure 1B:
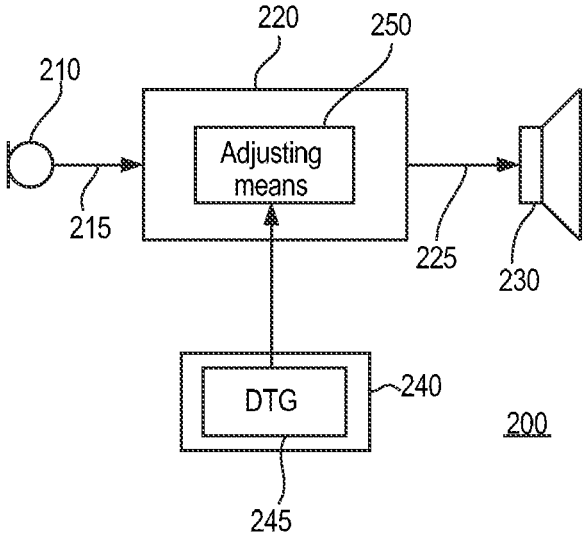
FIG. 1*b* depicts a block diagram of a hearing aid according to the present invention.

Reference is now made to FIG. 1 *b*, which shows a hearing aid 200 according to the first embodiment of the present invention.

The hearing aid comprises an input transducer or microphone 210 transforming an acoustic input signal into an electrical input signal 215, and an ND-converter (not shown) for sampling and digitizing the analogue electrical signal. The processed electrical input signal is then fed into signal processing means 220, which includes an amplifier with a compressor for generating an electrical output signal 225 by applying a compressor gain in order to produce an output signal suitable for compensating a hearing loss according to the users requirements. The compressor gain characteristic is, according to an embodiment, non-linear to provide more gain at low input signal levels and less gain at high signal levels. The signal path further comprises an output transducer 230, i.e. a loudspeaker or receiver, for transforming the electrical output signal into an acoustic output signal.

The compressor operates to compress the dynamic range of the input signals. It is useful for treatment of presbyscusis (loss of dynamic range due to haircell-loss). Actually, compressing hearing aids often apply expansion for low level signals, in order to suppress microphone noise while amplifying input signals just above that level. The compressor may also include a soft-limiter in order to limit maximum output level at safe or comfortable levels. The compressor has a non-linear gain characteristic and, thus, is capable of providing less gain at higher input levels and more gain at lower input levels. Hearing aids embodying a compressor in the signal processor are often referred to as non-linear-gain or compressing hearing aids.

The signal processing means further comprises memory 240 and adjusting means 250 for adjusting the hearing aid gain further over what the processor basically decides based on the users hearing deficit and the prevailing sound environment. This adjustment is intended to take into account certain effects of sounds bypassing the hearing aid, e.g. by bypassing the earpiece or by propagating through the vent, as will be explained below. By this adjustment, the hearing aid gain is calculated suitable to produce from the input signal a so called hearing deficit compensation output signal.

For the sake of computations, the sound bypassing the hearing aid is expressed in terms of direct transmission gain (DTG). The direct transmission gain (DTG) is defined as the sound pressure at the ear drum that is generated by an acoustic source outside the ear relative to a sound pressure at the exterior vent opening generated by the same source. As the direct transmission gain is typically less than one, the log value, expressed in dB, will normally be a negative number. However, as there is a natural Helmholz resonance by an earpiece placed in an ear canal there will be frequencies where the DTG is above one, i.e. the log value is a positive number. Information about the direct transmitted sound in the single frequency bands can be estimated, e.g. using the methods described in the document WO-A1-2007045271 to calculate a direct transmission gain for the hearing aid used by a certain user.

The DTG 245 calculated for the hearing aid as a set of frequency dependent gain values is stored in memory 240 of the hearing aid. The DTG is then used by the adjusting means 250 to adjust the hearing aid gain in order to reduce noise, avoid phase disruption or provide any other useful optimization or improvement of the signal quality in the combined acoustic signal on the ear drum resulting from the amplified output signal and the direct transmitted sound.

Figure 2:
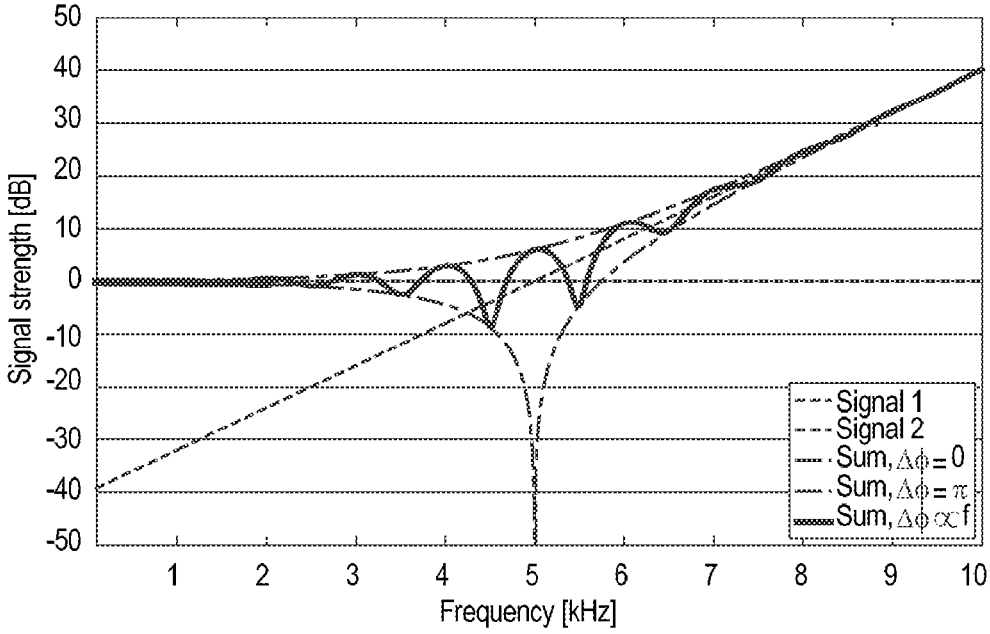
FIG. 2 depicts the level of signal versus frequency that results by adding contributions of two sound signals.

Reference is now made to FIG. 2, which depicts the level of signal versus frequency that results by adding contributions of two sound signals, and more specifically shows two frequency dependent signals with a relative phase which are added here, to clarify the principle of adding two sound signals at the eardrum. The black dotted lines are the magnitude of the two signals. The gray dash-dotted line represents the sum of these signals, when the two signals are in phase for all frequencies (upper curve), and when they are out of phase for all frequencies (lower curve), respectively. The full line shows what happens, if the phase difference varies linearly with frequency.

The sound level at the eardrum of the user is a superposition of the unaided direct sound and the sound amplified by the hearing aid. The interference of the two sound sources may lead to phase disruptions, i.e. fluctuations in the sound level at frequencies where the unaided direct sound and the amplified sound from the hearing aid has about the same magnitude but has opposite phase. This general phenomenon is illustrated in FIG. 2, which illustrates the addition of two signals with differing magnitude and phase.

At a certain frequency, the sum of two harmonic signals can be written as $$A_1 \cos(2\pi ft+\phi_1)+A_2 \cos(2\pi ft+\phi_2) \quad (1)$$

In our example, A1=1, $\phi_1=0$ and A2$\propto$f. $\phi_2$ is either 0, $\pi$ or $\propto$f. With simple calculations, both constructive and destructive interference can be verified, whereas the sum of two signals with frequency dependent phase and amplitude is more complex to describe analytically. In this case, the resulting phase disruption will depend on the amplitudes and phases of the signals. However, since constructive and destructive interference constitutes the upper and lower limit of the phase disruption, respectively, we know that a phase disrupted signal lies somewhere in between these lines, as shown in FIG. 2 for the case $\phi_2 \propto$f. Note that the ratio of the absolute amplitude corresponds to the difference of the amplitudes in dB, since dB is calculated as 20 log 10(A). An amplitude of 0 thus corresponds to $-\propto$ dB.

The lower dash-dotted gray line shows that in case the two signals are out of phase with the exact same amplitude, the total signal cancels out and becomes infinitely small. This is called destructive interference or phase cancellation. On the other hand, if the two signals are in phase at all frequencies, the amplitudes simply add up in a constructive interference, and gives 6 dB more sound pressure at the frequency where the two signals have the same amplitude, which can be seen in the upper dash-dotted gray line at 5 kHz. These two cases, however, are rarely met with respect to the hearing aid sound and the direct sound, since both have a varying frequency dependent phase. The black line therefore exemplifies how the total sound pressure might look like, if the relative phase depends linearly on frequency. Note, that at some frequencies, constructive interference increases the magnitude of the total signal, whereas for other frequencies, destructive interference diminishes the total signal. Since the signals do not cancel out as such at frequencies where the relative phase is almost $\pi$ and the relative amplitude is not quite 1, this phenomenon is called phase disruption.

The above example is general, and can be extrapolated to the situation in a users ear, where the amplified sound and the direct sound superpose. This in turn means that the amplified sound has to exceed a certain level before the total sound pressure at the eardrum remains unperturbed by the direct sound with respect to phase disruption. Maintaining the hearing aid gain at a similar magnitude to the direct sound would result in an increased risk of phase disruption, which is avoided with the current invention.

As is observed in FIG. 2, the difference in amplitude between the amplified sound and the unaided direct sound must be numerically higher than a certain amount (a safety margin) to minimize phase disruption. Thus, presuming a hearing aid gain higher than the direct transmission gain, there is a lower threshold for the setting of gain, equal to the directly transmitted gain +k, as suggested by the scale in FIG. 4 to the right. The safety margin is the factor k, which in principle could be set to anything. If k is negative and numerically large, the threshold will rarely affect the current gain, i.e. the interaction between direct and amplified sound is neglected and nothing extraordinary is done to take the interaction into account. If k is large and positive, measures are taken all the time, which is also not optimal. Choosing the factor k is therefore a trade-off between minimizing the risk of phase disruption and limiting the dynamic range of the hearing aid gain.

Figure 3:
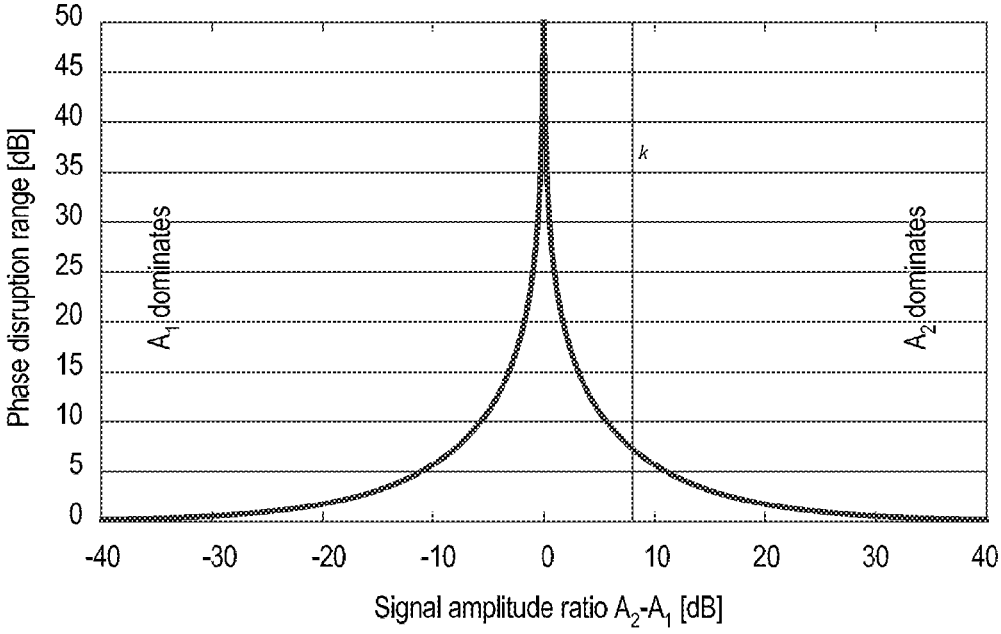
FIG. 3 depicts the phase disruption range as a function of the difference between the amplitude of the two signals.

FIG. 3 shows the phase disruption range versus signal amplitude ratio. FIG. 3 more specifically shows the difference in dB between the amplitude of the in-phase summed signal and the out-of-phase summed signal as a function of the difference between the amplitudes of the two signals shown in FIG. 2. FIG. 3 applies to just one band out of a number of frequency bands, which are generally processed in mutually similar way. The curve thus shows the uncertainty or possible spread of the total sound pressure due to phase disruption. The signal amplitude ratio in dB is the difference between the hearing aid sound (expressed in terms of gain) and the directly transmitted sound (expressed in terms of gain) in each band, i.e. HA-DTG (Direct Transmitted Gain) in dB, i.e. $A_1$ is DTG and $A_2$ is HA. Note, that the DTG is fixed once the earplug is made, whereas the hearing aid gain may change with the sound input. The hearing aid sound is thus the only variable, once the vent has been chosen.

For example it may be read from the plot that if one signal is 10 dB larger than the other, the phase disruption may in a worst case scenario cause the amplitude of the summed signal to vary up to −5 dB from the in-phase summed signal. Values from about 1 and upward are applicable, preferably between 5 and 15 dB. Of course, a value of about 1 dB would incur a high risk of phase disruption. A value of k=7 or k=8 gives a phase disruption range of about +−3 dB, which may be considered acceptable.

Similarly, in case of a hearing aid gain lower than the DTG, there should also be a safety margin, but in that case it would be an upper limit to the hearing aid gain.

If the hearing aid is turned off, the sound from the hearing aid will be $-\propto$ (completely silent), obviously meaning that the DTG will dominate totally. This corresponds to $-\propto$ on the x-axis in FIG. 3, which gives no phase disruption problems, as we would expect. On the contrary, if the hearing aid gain is e.g. 60 dB and the direct transmitted sound −10 dB, the direct sound is negligible in comparison, and also here no phase disruption is risked. It is only when the sound level of the direct sound and the hearing aid sound are comparable ($A_2 \approx A_1$), that the strength of the summed signal may vary significantly as indicated in FIG. 3.

Thus, in the current invention, presuming again a situation with a hearing aid gain higher than the DTG, the factor k, which is indicated by an example in FIG. 3, constitutes a lower limit, below which the hearing aid gain should normally not be set during the optimization process, due to the risk of a large amount of phase disruption. According to embodiments, below this limit actions are taken with regards to either turning off that particular band during fitting (stationary compensation) or dynamically reducing the hearing aid gain in case the limit is surpassed.

In the case where the direct sound at the eardrum in a particular band is similar in strength to the sound amplified by the hearing aid, the direct sound is actually adequate for the hearing aid user to hear the sound. Therefore, according to an embodiment, the means for adjusting the hearing aid gain, or a respective method step, simply turns off this band in order to avoid phase disruption. In open fittings, this is in particular relevant in the lowest bands, where most of the amplified sound is dampened due to the open fitting. According to an embodiment, a hearing aid with an open earplug, useful for preventing occlusion, has the 3 lowest bands of 15 turned off, whereas the 4 next bands may or may not be disabled by the adjusting means depending on the hearing aid gain in these bands.

Figure 4:
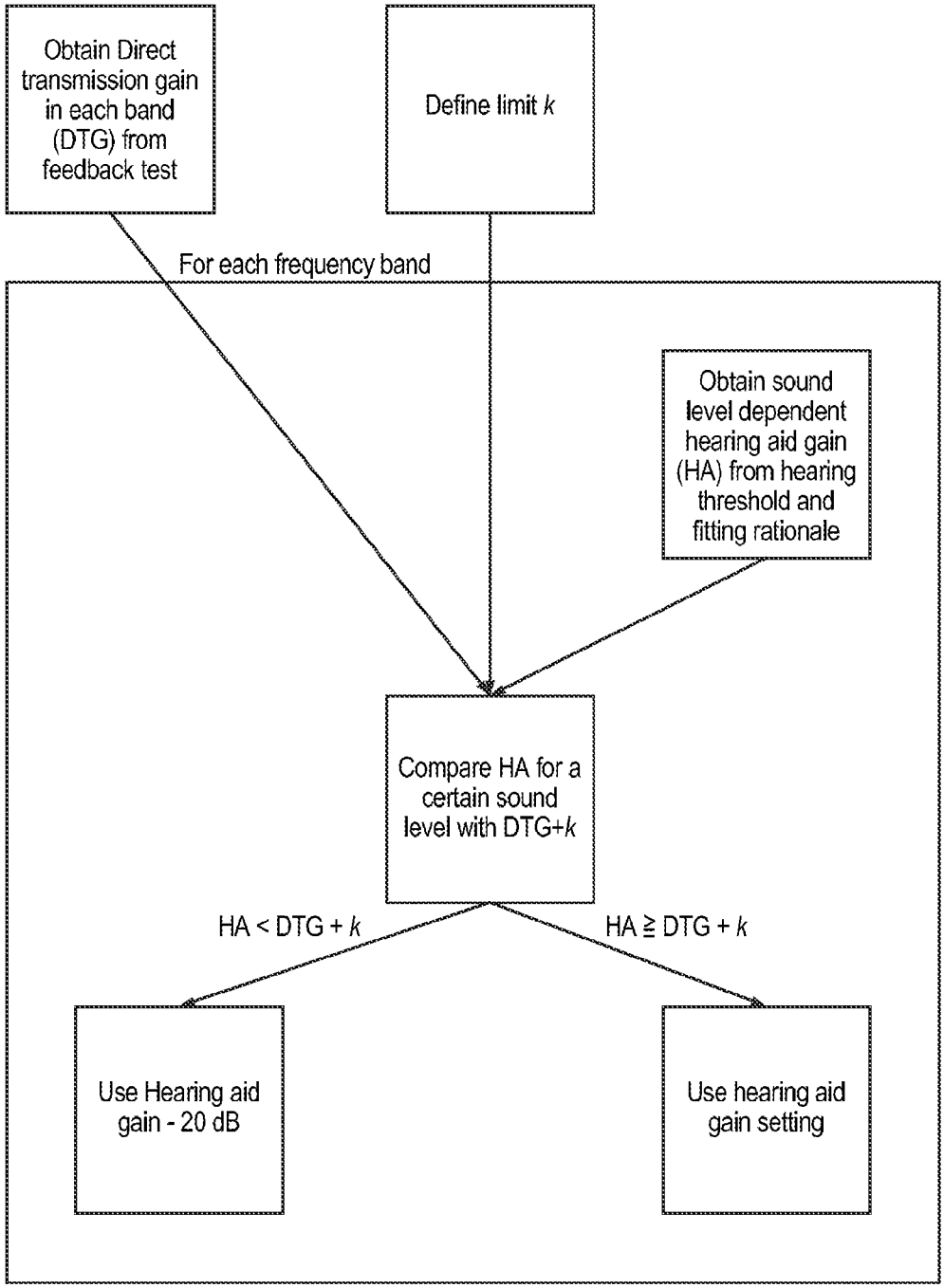
FIG. 4 depicts a flow diagram of a method according to an embodiment of the present invention.

According to the present invention, the compensation can either be static or dynamic. In FIG. 4, a flow chart for a static compensation according to an embodiment is shown. In the static case, the decision whether particular bands should be turned off is taken once during fitting, based on the gain setting of the hearing aid. The amplified sound in each band needs to be more than k dB higher than the direct sound in order to avoid phase disruption problems (explained in the other documents). Since we know both the gain and the direct sound, it is possible to determine whether gain in any band is necessary or not.

However, the gain in non-linear hearing aids depends on the input sound level, which means that the actual gain fluctuates with the input signal. That means that even though the vent has a permanent structure, the phase disruption problem may be present conditionally depending on the current sound environment, e.g. present at loud sounds (where the compressor sets the gain low) but not at soft sounds (where the compressor sets the gain high). This will be the case if the amplified sound level is close to the level of the direct sound for loud sounds, but well above for soft sounds. In the static case, preventing phase disruptions entirely will require that the bands are disabled based on the level gain for soft sounds, but this is likely to incur sacrificing bands that might otherwise have been desirable for amplification. Basing the consideration about disabling selected bands on higher levels of gain will not sacrifice so many bands but may leave situations where there can be phase disruptions. Thus, a balance between two extremes has to be found.

Figure 5:
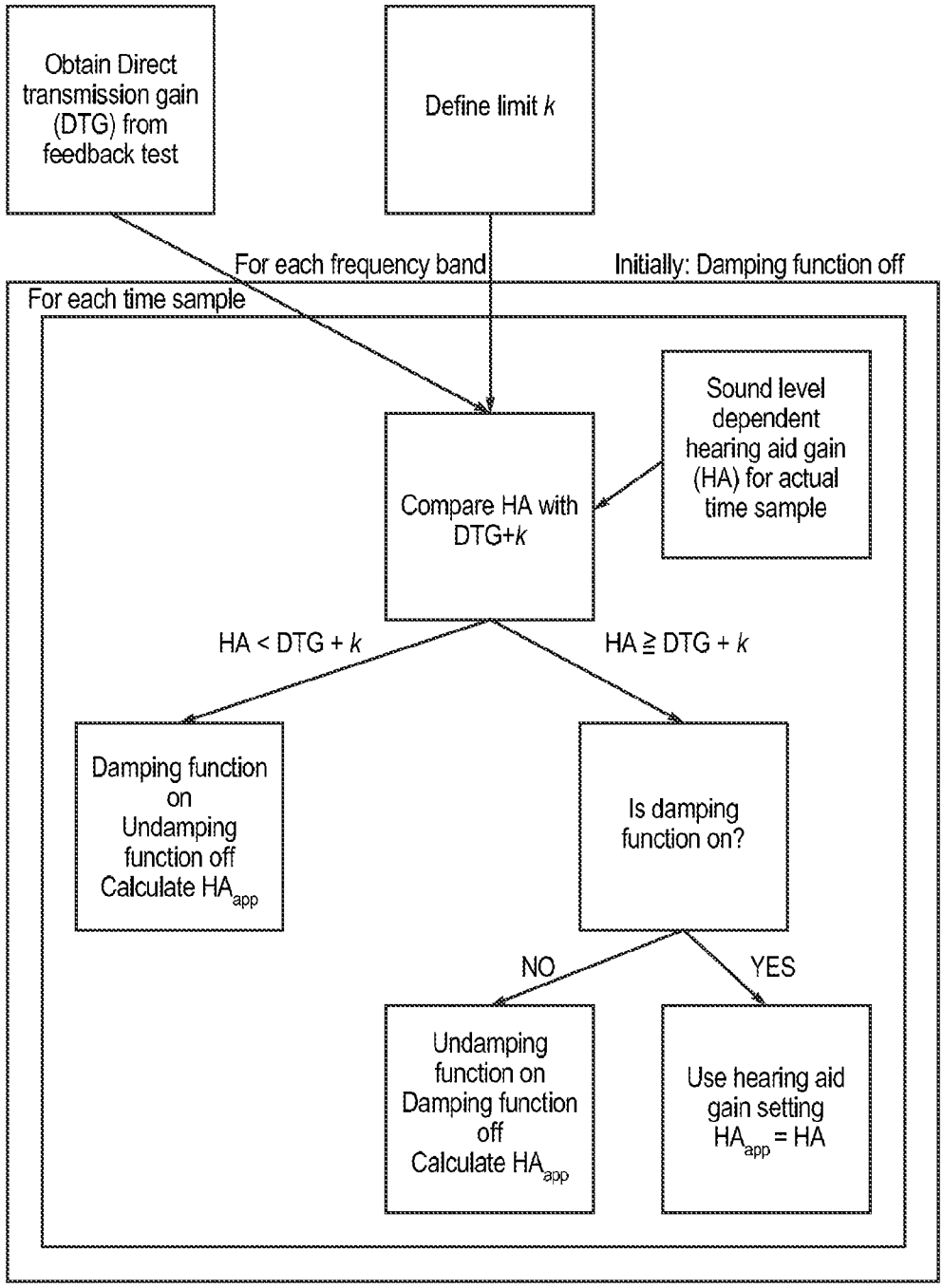
FIG. 5 depicts a flow diagram of a method according to another embodiment of the present invention.
Figure 6:
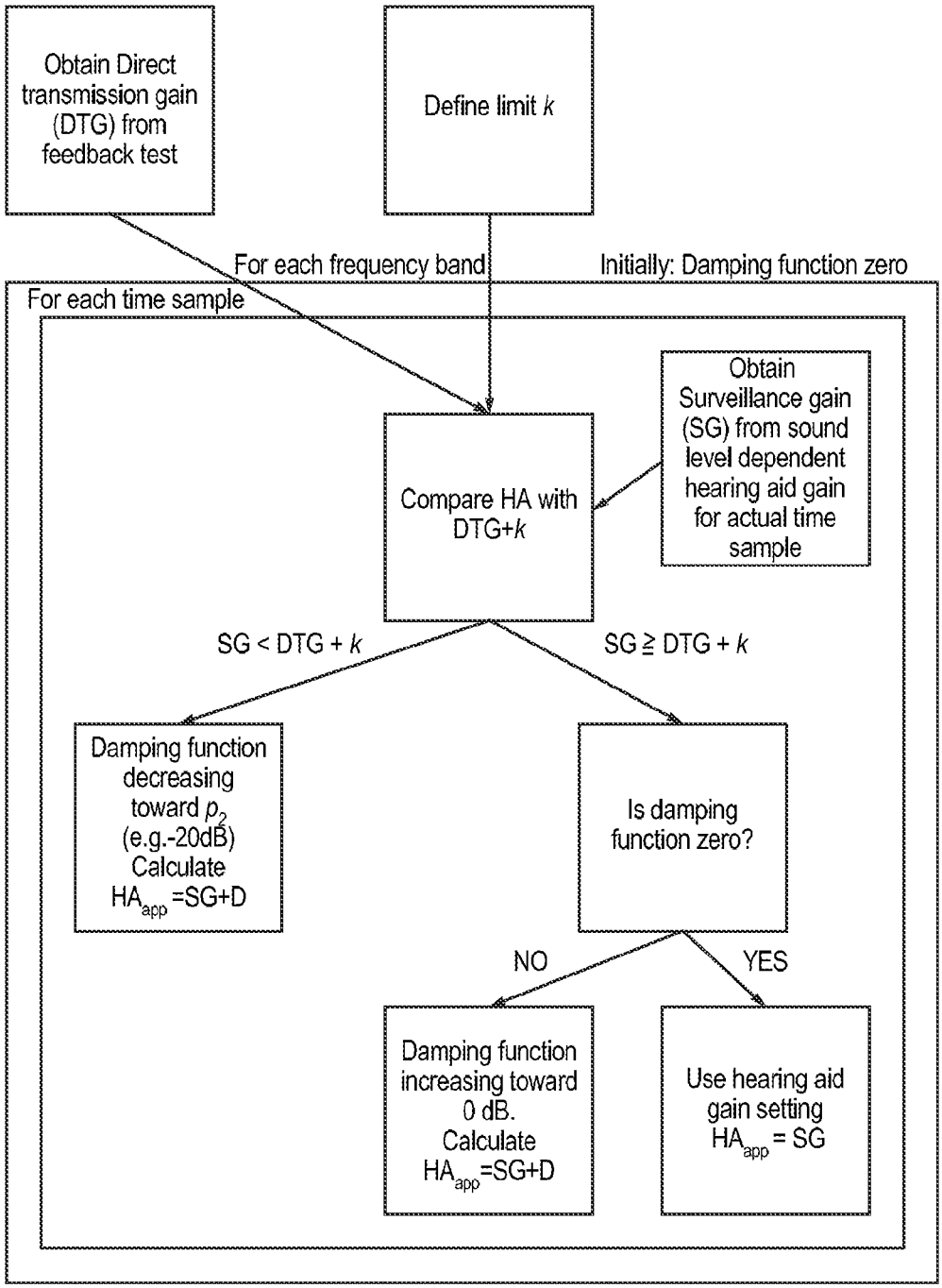
FIG. 6 depicts a flow diagram of a method according to a further embodiment of the present invention.

In FIGS. 5 and 6, flow charts for a dynamic compensation according to embodiments are shown.

Dynamic compensation takes the actual time dependent gain of the hearing aid into account and compares this to the direct transmitted sound, as estimated during fitting. In the dynamic case, bands are not disabled at the fitting. Instead, when the hearing aid gain is less than the limit (k dB), the gain is overlaid with a time dependent progressive damping. The actual gain is the sum of the damping function and the hearing aid gain as normally decided by the compressor. This could change the actual gain otherwise decided by the compressor by a factor of e.g. down to −20 dB, until the situation changes and the compressor acts to raise the hearing aid gain to a level higher than the limit again. At this point the damping will gradually return to zero. In this way, the hearing aid can automatically determine when the amplified sound becomes problematic during use, and successively account for this without perceptibly jeopardizing the sound quality.

For example, in the case where the hearing threshold is low and the vent is large, as is often the case for high frequency hearing losses, the sound level of sound passing through the vented earplug may be in the same order as the level of the sound generated by the hearing aid. However, since the hearing aid gain changes with the sound level, there may be some listening situations where the total sound signal at the eardrum is distorted by phase disruptions, whereas other listening situations may give a good sound quality because the hearing aid gain is well above or below the direct sound. For example, the hearing aid of a person at a crowded café will give a low gain due to the compression of the hearing aid. In the low bands, the hearing aid gain may be 0 dB, i.e. the hearing aid renders an output signal at a level equal to the input level. The directly transmitted sound may also be 0 dB in the low bands due to a large vent. In this case, the person may perceive a distorted sound due to phase disruptions. The same person may then go outside in a park and listen to birds and other people talking from afar. The hearing aid gain in the situation will be larger, and may thus be maybe 10 dB, which is high enough for the hearing aid sound to dominate the total sound at the eardrum, thus diminishing the risk of phase disruption and giving a better sound quality. In order to cope with this problem, there is provided a dynamic compensation according to the present invention as described in the following.

With reference to FIG. 6, the surveillance gain SG is the gain calculated in the hearing aid according to the current sound environment, the hearing threshold and the fitting rationale. This gain, which in the prior art, i.e. without compensation for the direct sound, would be applied as the hearing aid gain, is time sample by time sample compared to the minimal amplification limit, which is the direct sound plus a safety margin, i.e. DTG+k. The applied hearing aid gain ($HA_{app}$) is the gain applied to the signal to be rendered through the loudspeaker of the hearing aid. The applied hearing aid gain differs from the SG by the damping function D, such that $HA_{app}$=SG+D. If the surveillance gain is lower than DTG+k, the damping function is activated. The damping function may be defined in many ways, one of which may be $$D = \begin{cases} p_1 & \text{for } t < t_0 \\ f(t) & \text{for } t_0 \le t \le \Delta T + t_0 \\ p_2 & \text{for } t > \Delta T + t_0 \end{cases} \tag{2}$$

This function, beginning at time $t_0$, describes a gradual transition between two values of the damping function, $p_1$ and $p_2$. The value ΔT is the total duration of the damping signal, i.e. the time for the damping to complete. By choosing ΔT very small, the applied hearing aid gain is rapidly dampened, so the hearing aid sound is rapidly turned off.

Figure 7:
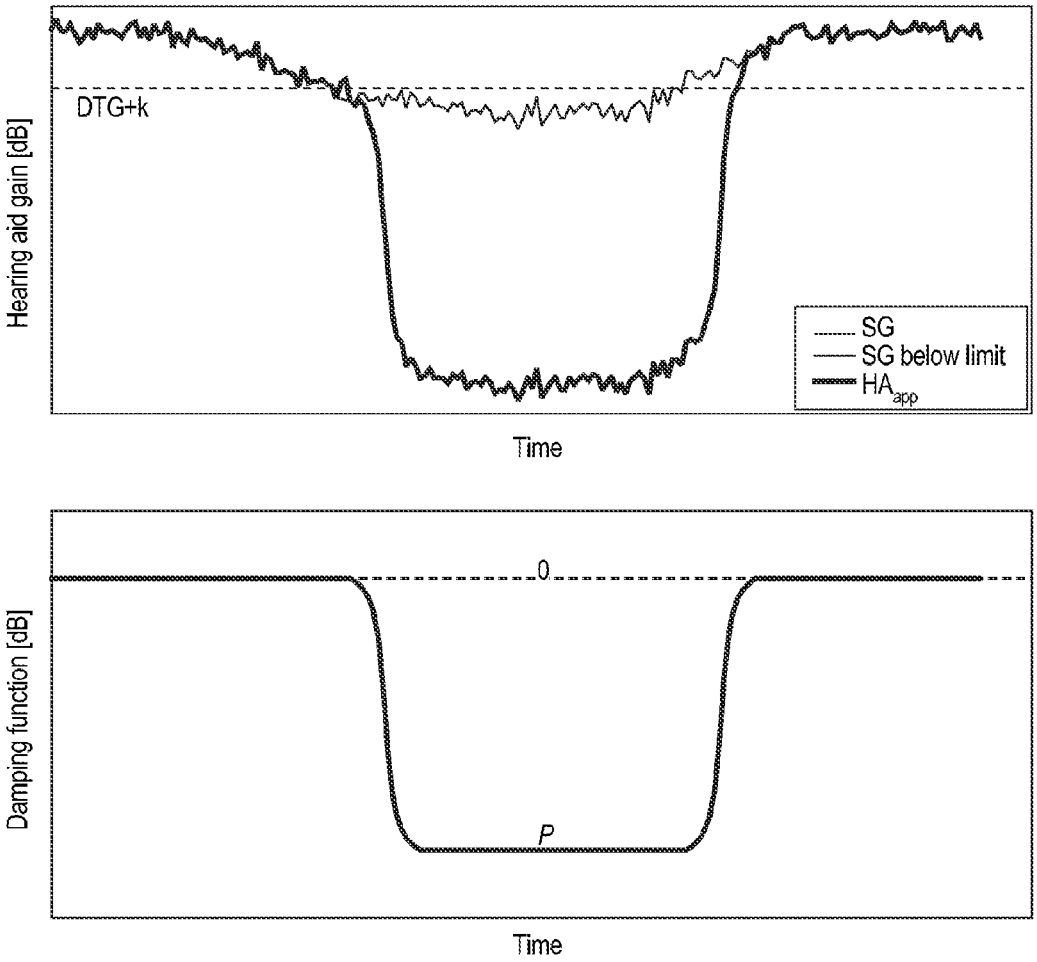
FIG. 7 shows in diagrams the hearing aid gain and the damping function in an example of the damping of the applied hearing aid gain in the case where the hearing aid gain becomes smaller than the minimal amplification limit according to an embodiment of the present invention.

FIG. 7 has two panes, the upper one showing a time plot of gain in a situation of fluctuating compressor gain setting due to a fluctuating input sound level and as adjusted by the application of the damping factor, and the lower one showing a time plot of a setting of the damping factor in phase of transition from zero to −20 dB and later back again from −20 dB to zero.

The initial transition is launched as soon as the criterion SG<DTG+k is fulfilled, whereby the applied gain begins to fall from $p_1$=0 dB toward the maximum numerical value of the damping P, which may be set at −20 dB as indicated in FIG. 7. The maximum numerical value of the damping P must be chosen small enough for the applied gain to generate a sound level at the eardrum, which is insignificant with regards to the direct sound, such that the risk for phase disruption is inconsequential. In the event the criterion is no longer met before the damping has reached equilibrium a new cycle is commenced, where $p_1$ is now the actual value of the damping function at the particular time the criterion state was changed, and $p_2$=0 dB. As soon as the criterion SG<DTG+k is not fulfilled anymore, the applied gain begins to rise again toward the surveillance gain, SG. This means that every time the criterion is met, the damping function dampens the applied hearing aid gain towards e.g. −20 dB during ΔTs. Every time the criterion is not met, the damping function will seek to rise to 0 dB.

Figure 8:
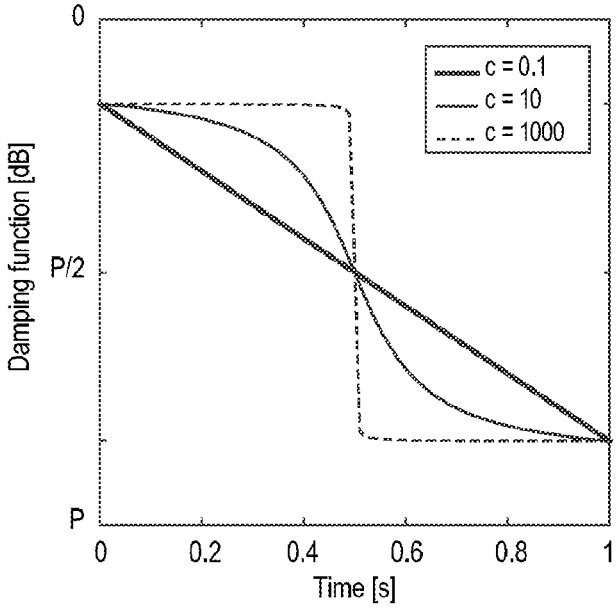
FIG. 8 shows the damping function for different compression factors, according to an embodiment of the present invention.

In FIG. 8 the damping function is shown for different compression factors, when at time $t=t_0$ the SG becomes smaller than the minimal amplification limit, and stays below for over 1 second. This provides a prompt yet smooth transition.

An example of f(t) may be $$f(t) = \frac{p_2 - p_1}{2} \frac{\text{Arctan}c(t - \Delta T/2)}{\text{Arctan}c\Delta T/2} + \frac{p_2 - p_1}{2} \tag{3}$$

The compression factor c controls how abruptly the transition should occur. With a high c, the transition occurs abruptly at ΔT/2, whereas a very low c makes an almost linear transition between $p_1$ and $p_2$. Note that there is a time delay since the damping function needs time to have an effect. FIG. 7 further shows an example of the dynamical compensation for direct sound where ΔT=1 s and c=10 $s^{-1}$.

Figure 9:
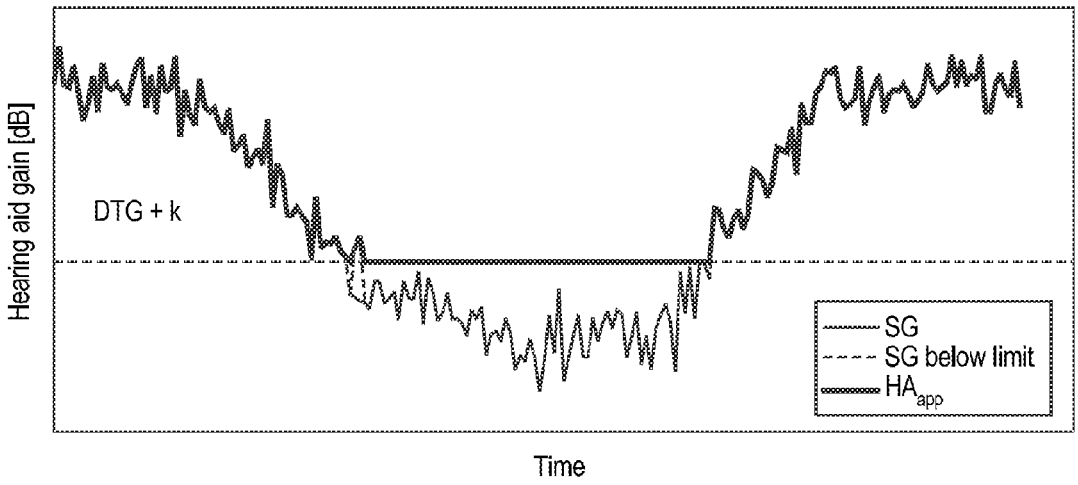
FIG. 9 shows in a diagram the hearing aid gain when it is restricted downward by the DTG+k, according to an embodiment of the present invention.

According to another embodiment of the present invention, a hearing aid gain is provided that is restricted by the minimal amplification as illustrated in FIG. 9. According to this embodiment, compensation for the DTG as implemented by never letting the hearing aid gain get lower than HA=DTG+k. This means that the original gain is modified with a damping function, which always generates an applied gain that is DTG+k or above. This method may be used either on its own, or in conjunction with a static compensation, such that some bands may be turned off, whereas other bands may be ruled by the dynamic compensation by restricting the gain to a minimal value of DTG+k. When the damping function is added to the gray part of the hearing aid gain, the flat line results as shown in FIG. 9. According to embodiments of the present invention, systems and hearing aids described herein may be implemented on signal processing devices suitable for the same, such as, e.g., digital signal processors, analogue/digital signal processing systems including field programmable gate arrays (FPGA), standard processors, or application specific signal processors (ASSP or ASIC). Obviously, it is preferred that the whole system is implemented in a single digital component even though some parts could be implemented in other ways—all known to the skilled person.

Hearing aids, methods, systems and other devices according to embodiments of the present invention may be implemented in any suitable digital signal processing system. The hearing aids, methods and devices may also be used by, e.g., the audiologist in a fitting session. Methods according to the present invention may also be implemented in a computer program containing executable program code executing methods according to embodiments described herein. If a client-server-environment is used, an embodiment of the present invention comprises a remote server computer that embodies a system according to the present invention and hosts the computer program executing methods according to the present invention. According to another embodiment, a computer program product like a computer readable storage medium, for example, a floppy disk, a memory stick, a CD-ROM, a DVD, a flash memory, or another suitable storage medium, is provided for storing the computer program according to the present invention.

According to a further embodiment, the program code may be stored in a memory of a digital hearing device or a computer memory and executed by the hearing aid device itself or a processing unit like a CPU thereof or by any other suitable processor or a computer executing a method according to the described embodiments.

Having described and illustrated the principles of the present invention in embodiments thereof, it should be apparent to those skilled in the art that the present invention may be modified in arrangement and detail without departing from such principles. Changes and modifications within the scope of the present invention may be made without departing from the spirit thereof, and the present invention includes all such changes and modifications.

What is claimed is:

1. A hearing aid comprising at least one microphone, a signal processing means and an output transducer, said signal processing means being adapted to receive an input signal from the microphone, and to apply a hearing aid gain to said input signal to produce an output signal to be output by said output transducer, wherein said signal processing means further comprises means for adjusting said hearing aid gain to a magnitude that differs by a predetermined margin from a direct transmission gain calculated for direct sound bypassing the hearing aid when worn by the user, said hearing aid further comprising a memory adapted to store said direct transmission gain calculated for said hearing aid, and adapted to provide a sound level dependent hearing aid gain, wherein said means for adjusting said hearing aid gain is adapted to apply said sound level dependent hearing aid gain to said input signal to produce a hearing aid gain amplified output signal, and wherein said hearing aid gain is adjusted if said hearing aid gain is equal to or lower than said direct transmission gain.

2. The hearing aid according to claim 1, wherein said signal processing means comprises a comparator adapted to compare said hearing gain with said direct transmission gain plus said predetermined margin, and, if said hearing aid gain is smaller than said direct transmission gain plus said predetermined margin, said means for adjusting said hearing aid gain is adapted to lower said hearing aid gain by a factor F and to use said lowered hearing aid gain to produce said amplified output signal, and, if said hearing aid gain is equal or larger than said direct transmission gain plus said predetermined margin, said means for adjusting said hearing aid gain is adapted to use said hearing aid gain to produce said amplified output signal.

3. The hearing aid according to claim 1, wherein said sound level dependent hearing aid gain comprises a set of frequency and input signal level dependent gain values obtained according to the user hearing threshold and a fitting rationale.

4. The hearing aid according to claim 1, wherein said signal processing means is further adapted to obtain an actual time sample of said input signal, and to calculate a surveillance gain from said sound level hearing aid gain for said actual time sample, wherein said hearing aid comprises a comparator adapted to compare said surveillance gain with said direct transmission gain plus said predetermined margin, and, if said surveillance gain is smaller than said direct transmission gain plus said predetermined margin, said means for adjusting said hearing aid gain is adapted to decrease a damping function toward a factor F, and, if said surveillance gain is equal to or larger than said direct transmission gain plus said predetermined margin, said means for adjusting said hearing aid gain is adapted to increase said damping function toward 0 dB, and said means for adjusting said hearing aid gain is adapted then to calculate said hearing aid gain by adding said damping function to said surveillance gain, and to use said calculated hearing aid gain to produce said amplified output signal.

5. The hearing aid according to claim 4, wherein said surveillance gain comprises a set of frequency dependent gain values obtained from said sound level dependent hearing aid gain set at said actual time sample.

6. A method of compensating direct transmitted sound in a hearing aid, comprising:

estimating an effective vent parameter for said hearing aid;

calculating a direct transmission gain based on said effective vent parameter;

calculating a hearing aid gain suitable to produce from an input signal a hearing deficit compensated output signal;

comparing the hearing aid gain to said direct transmission gain; and further adjusting said hearing aid gain up or down to a magnitude that differs from said direct transmission gain by more than a predetermined value.

7. The method according to claim 6, wherein said method comprises:

storing a direct transmission gain calculated for direct sound bypassing said hearing aid when worn by its user in a memory of said hearing aid;

providing a sound level dependent hearing aid gain; and applying said sound level dependent hearing aid gain to said input signal to produce a hearing aid gain amplified output signal, wherein said hearing aid gain is adjusted to a magnitude that differs by a predetermined margin from said direct transmission gain.

8. The method according to claim 7, wherein said method further comprises, selecting for said predetermined margin a value in the range between 0 and 15 dB, preferably between 5 dB and 15 dB, and more preferably a value of 7 to 8 dB.

9. The method according to claim 8, wherein said step of adjusting said hearing aid gain comprises:

comparing said hearing gain with said direct transmission gain plus said safety margin;

if said hearing aid gain is smaller than said direct transmission gain plus said safety margin, lowering said hearing aid gain by a factor F and using said lowered hearing aid gain to produce said amplified output signal;

if said hearing aid gain is equal or larger than said direct transmission gain plus said safety margin, using said hearing aid gain to produce said amplified output signal.

10. The method according to claim 8, further comprising:

obtaining an actual time sample of said input signal;

calculating a surveillance gain from said sound level hearing aid gain for said actual time sample;

comparing said surveillance gain with said direct transmission gain plus said safety margin;

if said surveillance gain is smaller than said direct transmission gain plus said safety margin, decreasing a damping function toward a factor F;

if said surveillance gain is equal or larger than said direct transmission gain plus said safety margin, increasing said damping function toward 0 dB;

calculating said hearing aid gain by adding said damping function to said surveillance gain; and using said calculated hearing aid gain to produce said amplified output signal.

11. The method according to claim 10, wherein said surveillance gain comprises a set of frequency dependent gain values obtained from said sound level dependent hearing aid gain set at said actual time sample.

12. The method according to claim 9, wherein said hearing aid gain is not allowed to be set to a value below said direct transmission gain plus said safety margin.

13. The method according to claim 6, comprising the step of converting said input signal into band-split input signals of a plurality of frequency bands and wherein said method is further carried out for each of said frequency bands.

14. The method according to claim 13, wherein said method is applied in selected frequency bands, wherein said method further comprises enabling or disabling of said method in certain frequency bands based on said hearing aid gain, and on said direct transmission gain.

15. A computer program product containing a non-transitory computer readable medium with executable program code which, when executed on a computer, executes a method of compensating direct transmitted sound in a hearing aid, the method comprising:

estimating an effective vent parameter for said hearing aid;

calculating a direct transmission gain based on said effective vent parameter;

calculating a hearing aid gain suitable to produce from an input signal a hearing deficit compensated output signal;

comparing the hearing aid gain to said direct transmission gain; and further adjusting said hearing aid gain up or down to a magnitude that differs from said direct transmission gain by more than a predetermined value.

16. A hearing aid comprising at least one microphone, a signal processing means and an output transducer, said signal processing means being adapted to receive an input signal from the microphone, and to apply a hearing aid gain to said input signal to produce an output signal to be output by said output transducer, said signal processing means being further adapted to:

estimate an effective vent parameter for said hearing aid;

calculate a direct transmission gain based on said effective vent parameter;

calculate a hearing aid gain suitable to produce from said input signal a hearing deficit compensated output signal; and compare the hearing aid gain to said direct transmission gain; and further adjust said hearing aid gain up or down to a magnitude that differs from said direct transmission gain by more than a predetermined value.

17. The hearing aid according to claim 16, further comprising a band-split filter for converting said input signal into band-split input signals of a plurality of frequency bands, wherein said hearing aid is further adapted to process said band-split input signals in each of said frequency bands independently, and wherein said means for adjusting said hearing aid gain is adapted to apply said frequency dependent hearing aid gain in selected frequency bands, preferably based on said hearing aid gain in these frequency bands.

* * * * *